US006453985B2

(12) United States Patent
Nakata et al.

(10) Patent No.: US 6,453,985 B2
(45) Date of Patent: Sep. 24, 2002

(54) METHOD OF CONTINUOUS CASTING OF MOLTEN METAL

(75) Inventors: Hitoshi Nakata, Tokyo-to; Takeshi Inoue; Hideo Mori, both of Kakogawa, all of (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/736,143

(22) Filed: Dec. 15, 2000

(30) Foreign Application Priority Data

Dec. 28, 1999 (JP) ..... 11-375276
Jul. 28, 2000 (JP) ..... 2000-229776

(51) Int. Cl.[7] ..... B22D 11/00; B22D 11/051; B22D 27/02

(52) U.S. Cl. ..... 164/466; 164/478

(58) Field of Search ..... 164/466, 502, 164/478, 416

(56) References Cited

U.S. PATENT DOCUMENTS 5,191,928 A 3/1993 Sato et al.

FOREIGN PATENT DOCUMENTS

JP 6-246405 * 9/1994
JP 11-216545 * 8/1999

OTHER PUBLICATIONS

M. Morishita, et al., CAMP–ISIJ, vol. 5, p. 200, "Improvement of Surface Quality of Continuously Cast Strand by Electromagnetic Mold," 1992 (with English Translation).

H. Nakata, et al., CAMP–ISIJ, vol. 6, p. 6, "Impovement of Surface Quality of Continuous Cast Billet By Electromagnetic Mold," 1993 (with English Translation).

H. Nakata, et al. CAMP–ISIJ, vol. 11, p. 138, "Influence of Division of Electromagnetic Mold on Billet Corner Surface Quality of Steel," 1998 (with English Translation).

T. Inoue, et al., CAMP–ISIJ vol. 12, pp. 53–54, "Improvement of Billet Surface Conditions by Ultra–High–Frequency EMC," 1999 (with English Translation).

(List continued on next page.)

*Primary Examiner*—Kuang Y. Lin
(74) *Attorney, Agent, or Firm*—Oblon, Spivak, McClelland, Maier & Neustadt, P.C.

(57) ABSTRACT

A method of continuously casting molten metal has the step of feeding molten metal into a mold to produce a casting continuously while generating an electromagnetic field in the mold by applying a high frequency to the mold. The application of the high frequency is controlled in such a manner that a magnitude of an electromagnetic field which is applied to a solidification shell forming start location of the mold becomes equal to or greater than a minimum required flux density to be applied to the mold. The minimum required flux density is determined according to the following equation:

$$B_{\min} = 1130 \times t_n - 5f \times (t_n - 0.05)$$

$B_{min}$: minimum required flux density (gauss)

$t_n$: negative time strip (second)

f: frequency in electromagnetic field (kHz)

v: casting velocity (m/sec)

$f_m$: number of oscillation or frequency of mold (Hz)

a: one-way stroke of mold (m).

5 Claims, 4 Drawing Sheets

OTHER PUBLICATIONS

T. Inoue, et al., The 3rd International Symposium on Electromagnetic Processing of Materials, pp. 392–395, "Improvement of Billet Surface Quality by Ultra–High–Frequency EMC," 2000.

H. Kim, et al., The 3rd International Symposium on Electromagnetic Processing of Materials, pp. 236–240, "Effect of Electromagnetic Field on Continuously Cast Steel Billet," 2000.

J. Park, et al., CAMP–ISIJ, vol. 12, pp. 57–60, "Effect of High Frequency Electromagnetic Field on Continuously Cast Billet," 1999.

Patent Abstracts of Japan, JP 4–178247, Jun. 25, 1992.

Patent Abstracts of Japan, JP 7–001093, Jan. 6, 1995.

* cited by examiner

METHOD OF CONTINUOUS CASTING OF MOLTEN METAL

BACKGROUND OF THE INVENTION

1. Field of the Invention

This invention relates to a method of continuous casting of molten metal, and more particularly pertains to a continuous casting method capable of effectively suppressing formation of oscillation mark and a wrinkle, which are likely to be formed on the surface of a casting by vibration or oscillation of the mold due to application of a high frequency, at a minimum required magnetic field intensity (namely with a minimum required consumption power). Such oscillation marks and the wrinkle are likely to be formed during continuous casting while generating electromagnetic field in the mold by application of a high frequency to a mold. Hereinafter, this technique is simply referred to as "high frequency continuous casting".

2. Description of the Related Art

CAMP-ISIJ vol. 5 (1992), p200, vol. 6 (1993) p6, vol. 11 (1998), p138, and vol. 12 (1999), p53 disclose a technique of applying a high frequency to an initial solidified part of molten metal (solidification shell) which is being solidified at an initial stage of continuous casting to improve the surface properties of a resultant casting by utilizing pinching force and heating effect resulting from electromagnetic force generated by application of the high frequency. According to this technique, longitudinal slits are formed, for example, into a copper mold, and a coil is wound around the copper mold at positions corresponding to the slits (the technique applied to a cooling-type crucible) in order to quickly penetrate the electromagnetic field throughout the mold. As disclosed in Japanese Unexamined Patent Publication No. 4-178247, the width of the longitudinal slit preferably ranges from 0.2 to 0.5 mm, considering workability, permeability of magnetic field, and prevention of molten metal penetration from the mold. The total length of the slit(s) is preferably 1.5 or more times as long as the total length of the coil in terms of permeability of magnetic field.

FIG. 1 is an elevational cross sectional view showing essential parts of a generally-used casting system for use in high frequency continuous casting. In FIG. 1, numeral 1 denotes a copper mold, 2 denotes a coil for applying a high frequency, 3 denotes a slit, 4 denotes an immersion nozzle for feeding molten metal into the mold 1, F denotes flux (mold powder), $M_L$ denotes molten metal, $M_S$ denotes a solidification shell.

The system is operated in such a manner that the molten metal $M_L$ is continuously fed into the mold 1 through the immersion nozzle 4 while acting an electromagnetic force to the initial solidified part of the molten metal $M_L$, namely, the solidification shell $M_S$ through a magnetic field which is generated by energizing the coil 2. Pinching force on the initial solidified molten metal is activated by the electromagnetic force along with the heating effect on the mold, while a casting which has been molded from the solidification shell $M_S$ is continuously or intermittently withdrawn downwardly from the system.

The flux F is loaded on the top portion of the molten metal $M_L$ inside the mold 1. The flux F serves to prevent heat radiation and to prevent oxidation of the molten metal $M_L$. The flux F is flow into a gap between the solidification shell $M_S$ and the mold 1 to make the contact surface therebetween smooth. Thus, the flux F also serves to improve the surface properties of the resultant casting.

There has been known a phenomenon that oscillation mark is likely to be formed on the surface of the casting due to up and down oscillation of the mold during the continuous casting. Oscillation mark, when the depth thereof is great, likely causes a crack in the resultant casting. Also, there has been known that inclusions and bubbles are likely to be entrapped in a so-called "hook" (a discontinuously solidified part of the casting which is likely to be formed underneath the outer surface of the casting) thereby causing defect in the casting. In view thereof, it is significantly important to find a technique of suppressing oscillation mark formation in order to produce a defect-free casting with good surface properties.

After intensive study of the high frequency continuous casting method of steel, the inventors of this invention accomplished and proposed the technique disclosed in Japanese Unexamined Patent Publication No. 7-1093. The publication discloses a technique of improving the surface properties of castings while suppressing the formation of oscillation marks on the surface of castings. Particularly, the disclosed technique is a technique of properly controlling an electromagnetic field intensity or a magnitude of an electromagnetic field (in other words, magnetic flux density) of a core or hollow portion of the mold depending on the casting velocity in order to stabilize a meniscus portion of the molten metal in the mold or molten bath. According to this technique, the quantity of flux (mold powder) supplied into a gap between the initial solidification shell $M_S$ and the mold 1 is properly controlled without causing excessive internal flow in the molten bath. Employing this technique enables to raise the casting velocity to a certain level while suppressing deterioration of the surface properties of the casting.

In addition, the aforementioned technique is advantageous in the following aspects.

(i) Pinching force generated by a magnetic field enlarges the gap for the flux inflow between the initial solidification shell and the mold, thereby improving contact surface smoothness between the mold and the resultant casting. Consequently, stabilized high speed casting is secured while suppressing formation of oscillation mark.

(ii) The pinching force on the initial solidification shell brings the resultant casting into gentle contact with the mold. This is effective in suppressing adverse influence to the casting which is likely to be caused by oscillation of the mold, thereby contributing to suppression of oscillation mark formation to some extent.

(iii) The surface of the molten metal in the mold is heated up by the electromagnetic force during application of a high frequency. Spontaneously, the heat generated by the electromagnetic force starts solidifying the molten metal from the top surface thereof. This is effective in suppressing fluctuation of the molten metal surface, namely, a meniscus portion of the molten metal which may adversely affect formation of a solidification shell, thereby contributing to improvement of surface quality of the casting.

(iv) The combination of heating and pinching force enables to prevent the solidification shell from protruding above the top surface of the molten metal. This arrangement is effective in preventing entrapment of gas bubbles and inclusions in the solidification shell, thereby contributing to improvement of the properties underneath the outer surface of the casting.

The above technique is advantageous in various ways as mentioned above because the technique considers controllability of magnetic field intensity (magnetic flux density) in the core or hollow portion of the mold in such a manner that formation of oscillation mark is suppressed even under a condition where a deep oscillation mark is liable to be formed. However, the required field intensity varies depending on oscillation conditions of the mold, the publication does not give full consideration to field intensity required under this conditions to suppress formation of oscillation mark.

CAMP-ISIJ vol. 12 (1999), p57 reports an experiment concerning continuous molding of steel with use of a high frequency of 20 kHz. The publication reports that the experiment improved depth of oscillation mark from 0.6 mm to 0.2 mm. This report, however, is silent about an optimum field condition that enabled depth of oscillation mark to such a small value. Also, the experiment was performed under a single oscillation condition. The publication, accordingly, does not provide technical data relating to correlation between mold oscillation which affects depth of oscillation mark and magnetic field intensity required to suppress formation of oscillation mark.

It should be noted that depth of oscillation mark and negative time strip $t_n$ have a close correlation. The shorter the negative time strip $t_n$ is, the smaller the depth of oscillation mark is. Shortening the negative time strip $t_n$, however, resultantly increases the number of oscillation of the mold per unit time. The increased number of oscillation undesirably likely to form oscillation mark in a casting. Thus, there is room for developing the technique of completely eliminating formation of oscillation mark.

In the case where a mold is not oscillated or continuous casting is conducted in such a condition as to accomplish the negative time strip $t_n$ to 0 or less, there has been empirically known that a wrinkle, such as irregularity or disorder, is generated on the surface of a casting. Therefore, there is also room for elucidating magnetic field intensity required to securely prevent occurrence of such a defect.

SUMMARY OF THE INVENTION

It is an object of the present invention to provide a continuous casting method which has overcome the aforementioned problems residing in the prior art.

According to an aspect of this invention, a method of continuously casting molten metal comprises the step of feeding molten metal into a mold to produce a casting continuously while generating an electromagnetic field in the mold by applying a high frequency to the mold. The application of the high frequency is controlled in such a manner that a magnitude of an electromagnetic field which is applied to a solidification shell forming start location of the mold from which a solidification shell of the casting starts to be formed becomes equal to or greater than a minimum required flux density to be applied to the mold. The minimum required flux density is determined based on a negative time strip and a frequency in the electromagnetic field as operation parameters according to the following equation:

$$B_{min}=1130\times t_n-5f\times(t_n-0.05)$$

where $t_n=\cos^{-1}(v/2\pi\times f_m\times a)/(\pi\times f_m)$ $B_{min}$: minimum required flux density (gauss)

$t_n$: negative time strip (second)

f: frequency in electromagnetic field (kHz)

v: casting velocity (m/sec)

$f_m$: number of oscillation or frequency of mold (Hz)

a: one-way stroke of mold (m).

DETAILED DESCRIPTION OF THE PREFERRED EMBODIMENT OF THE INVENTION

It is evident in the technology of high frequency continuous casting that a smaller electromagnetic field intensity is required to suppress a smaller depth of oscillation mark than that to suppress a greater depth of oscillation mark. It is also known that a condition for applying a high frequency for generating electromagnetic field is closely related to the casting velocity and oscillating condition of the mold. In the case where an applied magnitude of electromagnetic field is smaller than a minimum magnitude of electromagnetic field required to make a once-appeared oscillation mark disappear during a negative time strip $t_n$, once-appeared oscillation mark cannot be completely erased. In this case, the negative time strip $t_n$ is determined depending on single casting condition.

On the other hand, if the applied magnitude of electromagnetic field exceeds a predetermined level, the resultant electromagnetic force becomes greater thereby greatly fluctuating a meniscus portion of the molten metal in the mold, which may increase the depth of oscillation mark. Further, such a greater magnitude of field may undesirably concentrate magnetic field to the slit portions in the mold thereby leading to a casting defect due to leakage of molten metal. Such a defect is one of surface quality deteriorations of resultant castings.

In view of the above, the inventors came up with an idea of producing castings with good surface properties at a minimum required consumption power by applying a minimum magnetic field intensity capable of letting once-appeared oscillation mark with a certain depth disappear during high frequency continuous casting, and carried out experiments based on this idea. To prove that this idea works well, the inventors performed experiments under various casting conditions. Preferred embodiments are described along with the result of experiments. It should be noted that the scope of the present invention is not limited to these experiments.

Specifically, the inventors found a minimal magnetic flux density required for most efficiently suppressing formation of oscillation mark by changing the electromagnetic field intensity and frequency (number of oscillations) to be applied to the mold under various fixed conditions of negative time strip $t_n$, based on the assumption that depth of oscillation mark varies depending on length of negative time strip $t_n$.

The minimal magnetic flux density at which formation of oscillation mark on the solidification shell can be effectively suppressed is determined under the following casting conditions established by varying the parameters: frequency in magnetic field, casting velocity, and mold oscillation condition. The detail is shown in Table 1 and FIG. 2:

Mold size: 150×150 mm, length 1069 mm

Slit spacing: 0.3 mm

Slit length: 220 mm

Figure 1:
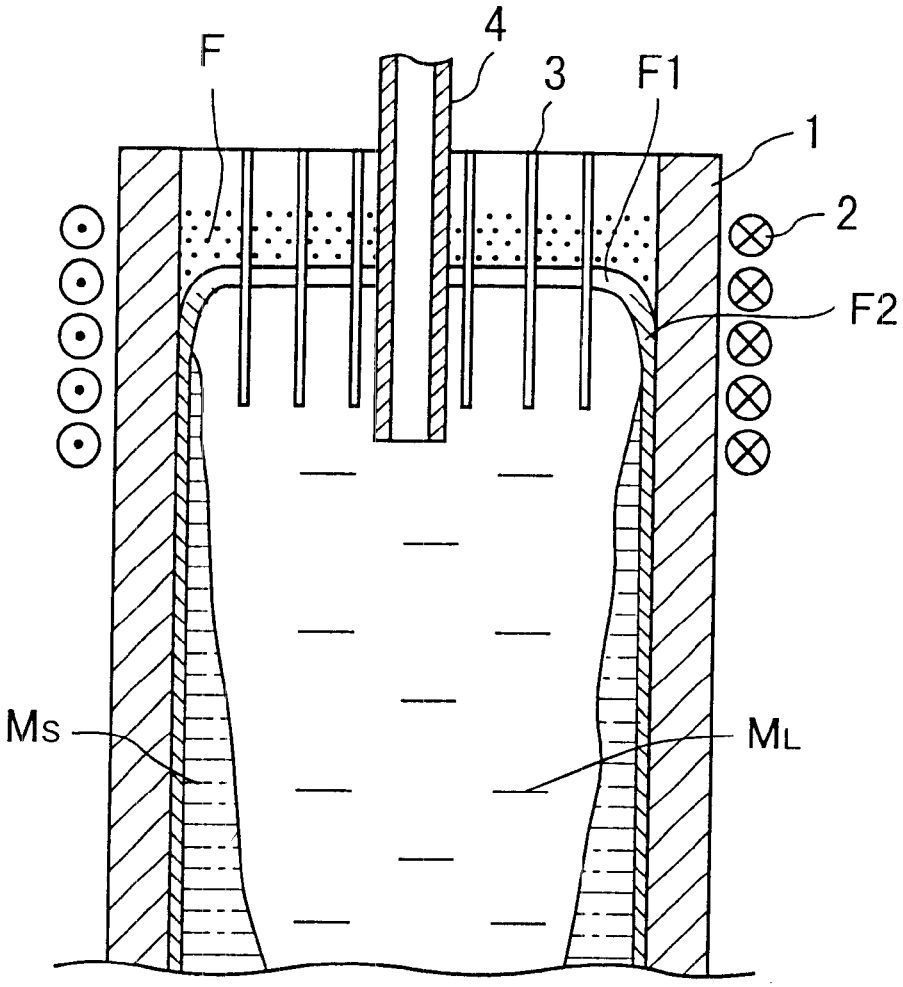
FIG. 1 is a schematic diagram showing an elevationally cross-sectional view of a generally-used continuous casting system to which a continuous casting method of this invention is applied.
Figure 2:
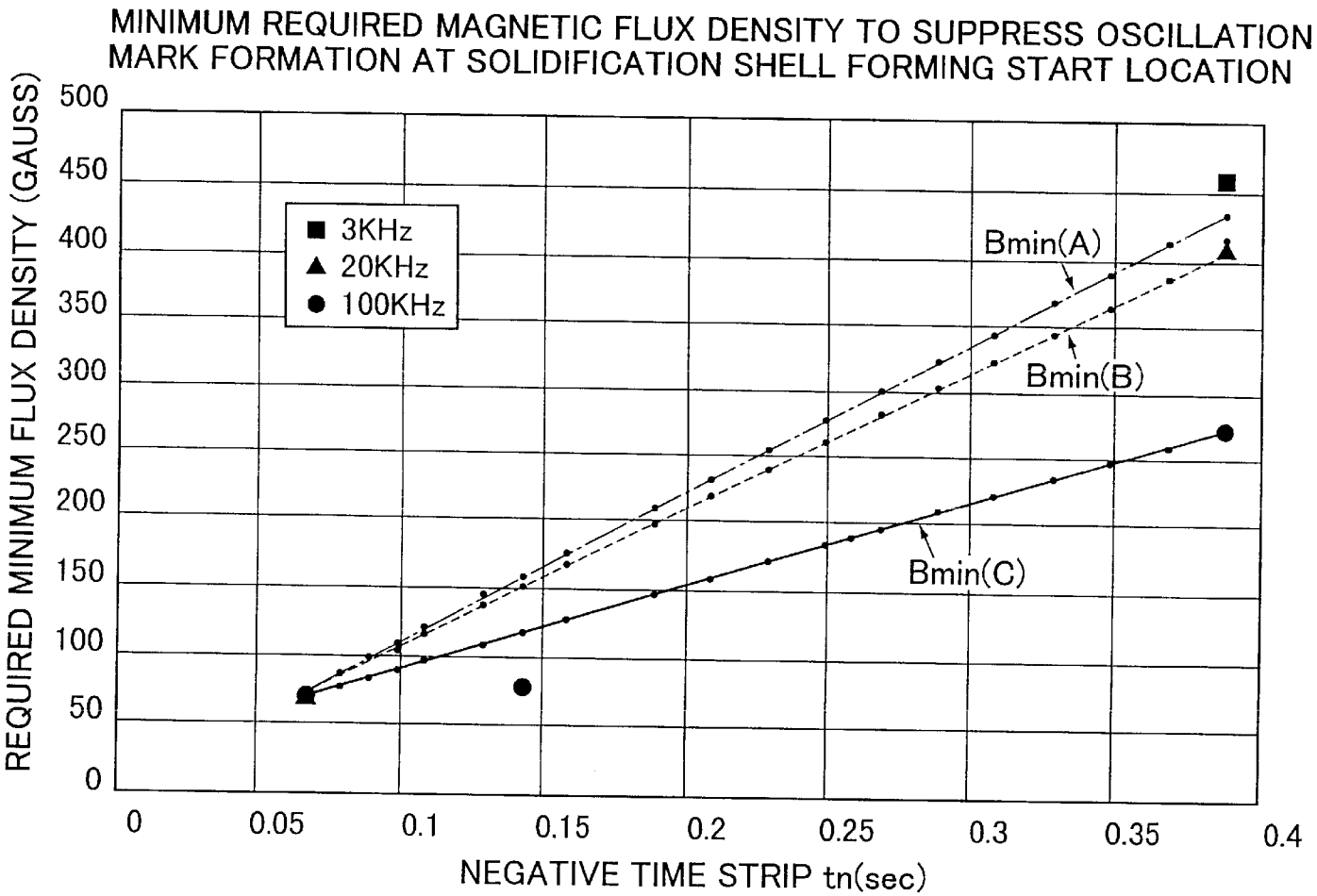
FIG. 2 is a graph showing a relation between a minimal flux density required to let a once-appeared oscillation mark disappear and a negative time strip.

Steel composition (100%): C:0.12%Si:0.20% Mn:0.50% rest:Fe and inseparable impurities frequency in magnetic field: 3 kHz, 20 kHz or 100 kHz casting velocity: 0.7 m/min, 1.2 m/min or 1.6 m/min mold oscillation: 1 Hz×10 mm, 3 Hz×7 mm or 7 Hz×3 mm It should be noted that mold oscillation condition is established by multiplying number of oscillation (Hz) applied to the mold by (reciprocating) stroke (mm). Also note that the straight lines $B_{min}$(A), $B_{min}$(B), and $B_{min}$(C) in FIG. 2 are interpolated lines by plotting out the minimal required magnetic flux densities $B_{min}$ at each negative time strip $t_n$ with respect to the applied frequencies 3 kHz, 20 kHz, and 100 kHz, respectively.

TABLE 1

| Casting Velocity | Oscillation condition | Negative time strip | Oscillation mark depth | minimum magnetic flux density required for oscillation mark suppression (gauss) | | |
|---|---|---|---|---|---|---|
| (m/min) | (Hz × mm) | (sec) | (*) (μm) | 3 kHz | 20 kHz | 100 kHz |
| 0.7 | 1.0 × ±10 | 0.38 | 600 to 700 | 450 | 400 | 260 |
| 1.2 | 3.0 × ±7 | 0.134 | 350 | — | — | 70 |
| 1.6 | 7.0 × ±3 | 0.057 | 200 | — | 60 | 60 |

(*): No application of electromagnetic force

As seen from Table 1, in the case where depth of oscillation mark is small, the influence of the frequency in the magnetic field is insignificant. Namely, oscillation mark having a depth of about 200 μm disappears when magnetic flux density of about 60 gauss is applied.

On the other hand, under the condition where depth of oscillation mark is great, the higher the frequency in the magnetic field is, the less the required magnetic flux density is. For instance, when the frequency is as low as 3 kHz, magnetic flux density as large as 450 gauss is required. On the other hand, when the frequency is as high as 100 kHz, the required magnetic flux density can be reduced as small as 260 gauss. It is conceived that this is due to the fact that the region around the meniscus portion of the molten metal in the mold (molten bath) is heated when an applied frequency is high, thereby enlarging the total thickness of a melting flux (mold powder) F1 where the supplied flux is on the way of melting and a flux liquefied part (lubrication layer) F2 where the flux has already been liquefied or is on the way of liquefying to render the contact portion between the mold and solidification shell smooth. The enlarged thick layer protects the casting or solidification shell from being oscillated as the mold is oscillated.

The relationship between the minimal required magnetic flux density $B_{min}$ and negative time strip $T_n$ in Table 1 and FIG. 2 is analyzed by using the frequency in a magnetic field as a parameter, the relation represented by equation (I) is established:

$$B_{\min} = 1130 \times t_n - 5f(t_n - 0.05) \quad \text{(I)}$$

wherein $t_n$: negative time strip (sec)

f: applied frequency in magnetic field (kHz)

Specifically, it was verified that controlling the magnitude B (unit: gauss) of the magnetic field which is applied to a region including a position where the solidification shell starts to be formed (hereinafter, referred to as "solidification shell forming start location") during the high frequency continuous casting so as not to lower a required minimal magnetic flux density $B_{min}$ (unit: gauss) can minimize the consumption power used for applying a high frequency to the coil at a minimum level while most effectively suppressing the formation of oscillation mark. It should be noted that the minimal required flux density $B_{min}$ is calculated by using the frequency f (unit: kHz) in the magnetic field and negative time strip $t_n$ (unit: sec) as operation parameters and implementing the calculation according to equation (I).

The negative time strip $t_n$ is a value which is defined according to equation (II):

$$t_n = \cos^{-1}(v/2\pi \times f_m \times a)/(\pi \times f_m) \quad \text{(II)}$$

wherein v: casting velocity (m/sec)

$f_m$: number of oscillation (in other words, mold frequency) (Hz)

a: one-way stroke of mold (in other words, length of one way amplitude of the oscillation) (m)

The oscillation condition is obtained by multiplying mold frequency $f_m$ by one-way stroke a of a mold.

To sum up the above, minimizing the magnitude B of the magnetic field as much as possible in such a level that the magnitude B is not lowered than the minimal required magnetic flux density $B_{min}$. The upper limit of the magnitude B is not specifically limited but if the applied magnetic field intensity is too strong, a meniscus portion of the molten metal may be fluctuated beyond a permissible level which may cause a defect (such as molten metal leakage) on the casting surface may likely to be formed. Therefore, an experiment was performed to verify as to how the applied frequency in the magnetic field affects formation of a defect including oscillation mark resulting from molten metal leakage due to fluctuation of a meniscus portion. As shown in Table 2, when magnetic flux density at the meniscus position is over 1000 Gauss (at 20 KHz) or 900 Gauss (at 100 KHz), the fluctuation of meniscus increases, and the leakage of solidified shell may be generated due to excess heat by alternating magnetic field.

TABLE 2

| Frequency (kHz) | magnetic field intensity at which meniscus portion starts to fluctuate or defect due to molten metal leakage starts to emerge (gauss) |
|---|---|
| 20 | 1000 |
| 100 | 900 |

An object of this invention is to provide a method of efficiently performing continuous casting of molten metal into a cast metal having good surface properties with minimized consumption power while suppressing formation of oscillation marks and the wrinkle resulting from molten metal leakage. This object is accomplished by controlling the magnitude B of magnetic field which is to be applied to the solidification shell forming start location not to lower the minimal required magnetic flux density $B_{min}$, more preferably, by controlling the magnitude B of magnetic field not to lower the minimal required magnetic flux density $B_{min}$ and not to exceed a maximal flux density at which a defect resulting from molten metal leakage starts to emerge.

It may be preferable that the upper end of the coil for applying a high frequency be matched with the upper surface of a meniscus portion, or the upper end of the coil be set in a range of at least ±20 mm relative to the upper surface of the meniscus portion when no electromagnetic force is activated inside the mold and the meniscus portion is kept in a stationary state. This is effective in more efficiently performing a high frequency continuous casting capable of producing defect-free castings. This technique is recommended because deviating the upper end of the coil relative to the upper surface of the meniscus portion which is set in a stationary state with non-application of high frequency beyond a predetermined range causes uneven distribution of magnetic field to the meniscus portion, which fluctuates the configuration (state) of the meniscus portion beyond a permissible range, and what is produced as a result of meniscus portion fluctuation is a solidification shell or casting with uneven thickness.

The inventors of this invention implemented an experiment to search for an optimal upper end position of the coil relative to the upper surface of the meniscus portion. In the experiment, the distance d (see the horizontal coordinate in the graph of FIG. 3) between the upper end of the coil and the upper surface of the meniscus portion which was kept in a stationary state with non-application of high frequency was changed step by step. Specifically, various casting experiments were performed such that the upper end of the coil was moved up or down stepwise relative to the upper surface of the meniscus portion starting from the distance d(=0) where the upper end of the coil was matched with the upper surface of the meniscus portion in a stationary state and under a condition of applying a magnetic field of such a level that once-appeared oscillation mark may disappear.

Figure 3:
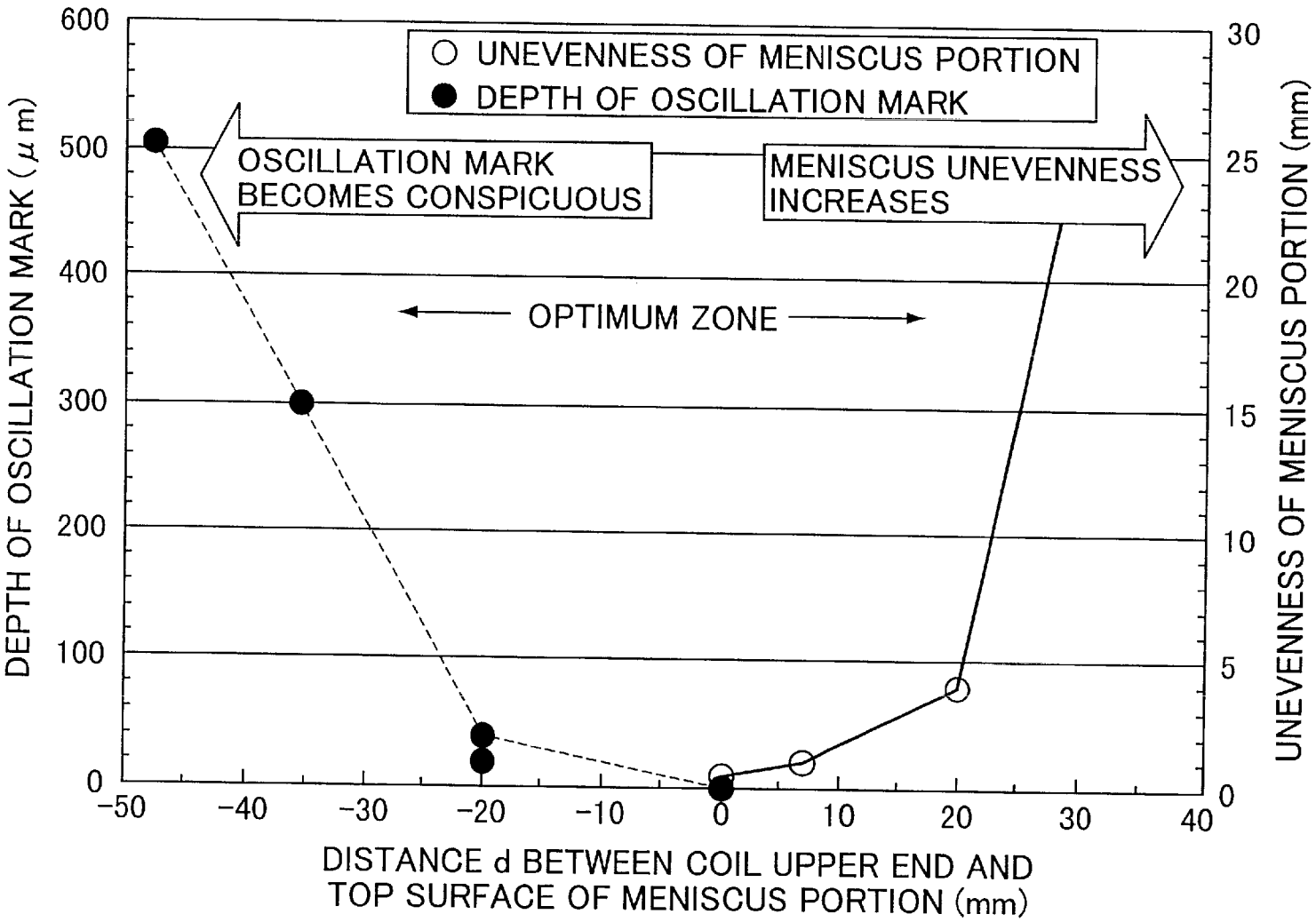
FIG. 3 is a graph showing as to how the distance between the upper end of an energizing coil and the top surface of a meniscus portion affects the depth of oscillation mark and disordered state or unevenness of the meniscus portion.

The result of the experiment is shown in FIG. 3. "UNEVENNESS OF MENISCUS PORTION" (see the right-side scale in FIG. 3) is represented by a level difference (mm) with respect to the top surface of the meniscus portion among each segment defined by the adjacent slits in the mold. The greater the difference is, the more conspicuous unevenness or disordered state of the meniscus portion is. Unallowable disordered state of the meniscus portion causes remarkable surface quality deteriorations of the resultant casting because solidification initiate points of the casting which should appear in a circumferentially aligned state are not aligned circumferentially.

As is obvious from FIG. 3, setting the upper end of the coil lower than the upper surface of the meniscus portion beyond 20 mm markedly increases formation of oscillation mark on the surface of the casting. This deteriorates the surface quality of the casting.

On the other hand, setting the upper end of the coil higher than the upper surface of the meniscus portion beyond 20 mm also causes remarkable disordered state of the meniscus portion, which is not desirable for the purpose of producing castings with good surface properties. An experiment was performed as to how the setting of the upper end of the coil relative to the meniscus portion higher than 20 mm affects fluctuation of the meniscus portion when a high frequency is applied. This experiment was performed through observing the state of the meniscus portion by way of melting tin in the mold.

The reason for melting tin in the meniscus portion in the above experiment is as follows. It is essentially important to know how the upper surface of molten steel (namely, meniscus portion) in a mold fluctuates when a high frequency is applied to the mold, namely, when an electromagnetic field is generated in the mold. However, since steel has a high melting point, it is difficult to melt the steel in a mold. A metal having a lower melting point (for instance, tin has a relatively low melting point of two hundred and several tens degrees in Centigrade (° C.)) enables to melt easily even in a water-cooled mold due to heat generated by application of a high frequency and retains its melted state. Monitoring the tin that has been melted in the surface of the molten steel enables to predict the configuration (state) of the surface (meniscus portion) of the molten steel. Accordingly, in this embodiment, adopted is a technique of loading a solid-state tin in a water-cooled mold and energizing the coil wound around the mold to melt the solid-state tin with heat so as to monitor the configuration (state) of the meniscus portion by way of observing the tin which has been melted.

As a result of performing the aforementioned experiments, it was proved that setting the upper end of the coil relative to the upper surface of the meniscus portion within the range of ±20 mm, more preferably, matching the level of the upper end of the coil with the top surface of the meniscus portion in a stationary state enables to markedly improve the surface properties of a casting by eliminating unevenness or disordered state of the meniscus portion and minimizing formation of oscillation mark.

The frequency to be applied to the coil is not determined in terms of one-to-one correspondence because the applied frequency varies depending on other factors such as dimensions of the mold and casting velocity. It may be preferable, however, to apply a frequency of 3 kHz or more, and more preferable to apply a frequency of 20 kHz or more in order to more effectively utilize pinching force and heating effect obtained by application of a high frequency.

The above embodiment is described for the case where the mold is withdrawn downwardly while oscillating the mold up and down. It has been empirically known that a wrinkle described in the embodiment is generated when the mold is not oscillated or in the case where continuous casting is performed under oscillation condition wherein the negative time strip $t_n$ is 0 or smaller. A technique of suppressing the wrinkle is described hereinafter as a modified embodiment.

Figure 4:
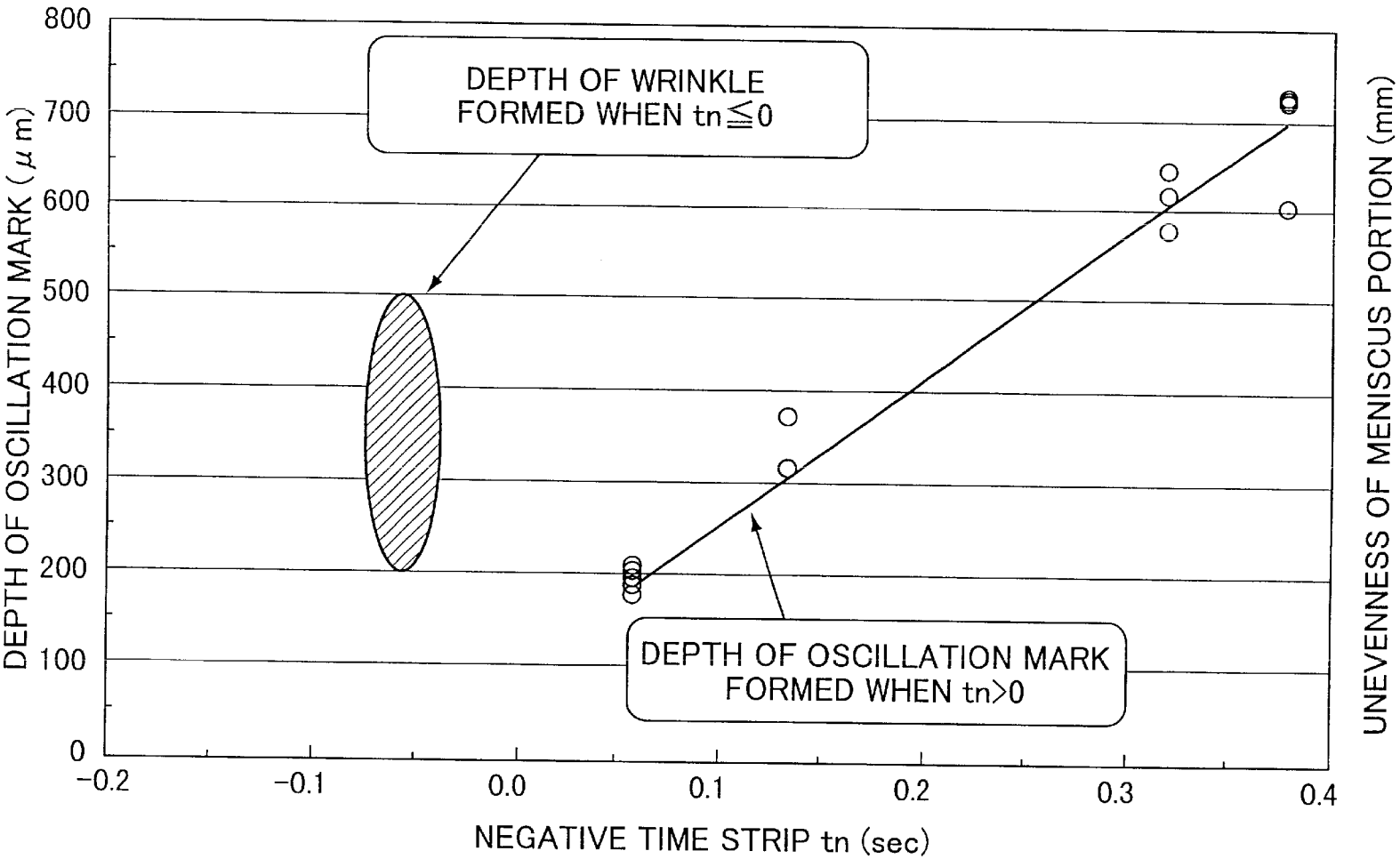
FIG. 4 is a graph where the depth of oscillation mark and the depth of the wrinkle are shown on the same scale based on the negative time strip.

The inventors of this invention also performed an experiment concerning suppression of the wrinkle. The result of the experiment is shown in FIG. 4. In FIG. 4, the depth of the wrinkle caused under the condition where the negative time strip $t_n \leqq 0$ and the depth of oscillation mark caused under the condition where the negative time strip $t_n > 0$ are shown based on the same scale. As seen from FIG. 4, the depth of the wrinkle ranges from 200 to 500 $\mu$m irrespective of the period of the negative time strip $t_n$ and a judgement as to whether the mold is oscillated. The wrinkle having the depth ranging from 200 to 500 $\mu$m corresponds to the oscillation mark of a depth which is formed on the casting when the negative time strip $t_n$ ranges from 0.057 to 0.25 second. It was verified that applying the same magnitude of field that is required to let a once-appeared oscillation mark of a depth corresponding to the wrinkle of about 500 $\mu$m in depth disappear is sufficient to let any wrinkle caused under the condition where $t_n \leqq 0$ disappear. This magnitude of field corresponds to a minimal required magnetic flux density.

This analysis leads to a fact that searching for $t_n$ value that causes formation of oscillation mark of a depth equivalent to the depth -of the wrinkle and implementing a calculation according to equation (I) with the searched $t_n$ value enables to determine a minimal required flux density which is effective in suppressing formation of the wrinkle. Implementing this technique enables to produce castings having good surface properties while suppressing the wrinkle.

For instance, in FIG. 4, a minimum negative time strip $t_n$ required for making the wrinkle of about 500 μm in depth disappear is about 0.25 second. Applying the $t_n$ value to an equation which is established from the graph shown in FIG. 2 leads to the following fact. Specifically, setting the minimal required flux densities at about 180 gauss, 260 gauss, and 280 gauss in respective cases where the frequencies are set at 100 kHz, 20 kHz, and 3 kHz enables to securely eliminate formation of the wrinkle.

As described in the foregoing, according to the present invention, properly controlling the frequency to be applied to the mold based on the negative time strip $t_n$ which is determined depending on the casting velocity and mold oscillation condition enables to suppress formation of oscillation mark and the wrinkle other than the oscillation mark. Thereby, castings having stabilized quality can be continuously and reliably produced.

It is needless to say that this invention is applicable not only to continuous casting of molten steel capable of easily activating electromagnetic force but also to continuous casting of any other metal including ferrite-based alloy except steel and molten metal such as aluminum and copper as far as the metal is a magnetized metal capable of activating electromagnetic force.

To sum up the present invention, an aspect of this invention is directed to a method of continuously casting molten metal comprising the step of feeding molten metal into a mold to produce a casting continuously while generating an electromagnetic field in the mold by applying a high frequency to the mold, the application of the high frequency is controlled in such a manner that a magnitude of an electromagnetic field which is applied to a solidification shell forming start location of the mold from which a solidification shell of the casting starts to be formed becomes equal to or greater than a minimum required flux density to be applied to the mold, the minimum required flux density being determined based on a negative time strip and a frequency in the electromagnetic field as operation parameters according to the following equation:

$$B_{\min} = 1130 \times t_n - 5f \times (t_n - 0.05)$$

$B_{min}$: minimum required flux density (gauss)

$t_n$: negative time strip (second)

f: frequency in electromagnetic field (kHz)

v: casting velocity (m/sec)

$f_m$: number of oscillation (namely, mold frequency) (Hz)

a: one-way stroke of mold (m).

It may be preferable to perform the continuous casting in such a manner that the upper end of a coil for applying a high frequency is aligned with the top surface of the meniscus portion of the molten metal in the mold which is kept in a stationary state with no application of a high frequency to the mold or that the upper end of the coil is aligned with the top surface of the meniscus portion in a stationary state within a range of ±20 mm. More preferably, setting the frequency f at 3 kHz or more enables to securely suppress formation of a defect on the surface of the casting including oscillation mark.

Alternatively, in the case where the negative time strip $t_n$ is 0 or less or the mold is not oscillated, a wrinkle is likely to be formed on the surface of the casting. In such a case, it may be preferable to control the minimum required flux density in such a manner that the depth of the defect other than the oscillation mark is suppressed by using the negative time strip that causes the oscillation mark of a depth corresponding to the depth thereof. With this arrangement, formation of a wrinkle can be securely prevented.

This application is based on patent application No. 2000-229776 filed in Japan, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A method of continuously casting molten metal comprising the step of feeding molten metal into a mold to produce a casting continuously while generating an electromagnetic field in the mold by applying a high frequency to the mold, the application of the high frequency is controlled in such a manner that a magnitude of an electromagnetic field which is applied to a solidification shell forming start location of the mold from which a solidification shell of the casting starts to be formed becomes equal to or greater than a minimum required flux density to be applied to the mold, the minimum required flux density being determined based on a negative time strip and a frequency in the electromagnetic field as operation parameters according to the following equation:

$$B_{\min} = 1130 \times t_n - 5f \times (t_n - 0.05)$$

$B_{min}$: minimum required flux density (gauss)

$t_n$: negative time strip (second)

f: frequency in electromagnetic field (kHz)

v: casting velocity (m/sec)

$f_m$: number of oscillation (Hz)

a: one-way stroke of mold (m).

2. The method according to claim 1 further comprising the step of, prior to application of the frequency, aligning an upper end of a coil for applying the frequency at a top surface of a meniscus portion of the molten metal in the mold when the electromagnetic field is not applied and the mold is set in a stationary state.

3. The method according to claim 1 further comprising the step of, prior to application of the frequency, aligning an upper end of a coil for applying the frequency at a top surface of a meniscus portion of the mold within a range of ±20 mm when the electromagnetic field is not applied and the mold is set in a stationary state.

4. The method according to claim 1, wherein the frequency to be applied to the mold is set at 3 kHz or more.

5. The method according to claim 1, wherein the minimum required flux density is controlled in such a manner that a depth of a wrinkle on a surface of the casting is suppressed by using the negative time strip that causes the oscillation mark of a depth corresponding to the depth thereof under a condition where the negative time strip is 0 or less, or the mold is not oscillated.

* * * * *